United States Patent [19]

Costa

[11] Patent Number: 5,002,278

[45] Date of Patent: Mar. 26, 1991

[54] RACKET

[76] Inventor: Juan C. Costa, 2564 Navarra Dr., #116, Carlsbad, Calif. 92008

[21] Appl. No.: 435,254

[22] Filed: Nov. 13, 1989

[51] Int. Cl.[5] ..... A63B 49/06

[52] U.S. Cl. ..... 273/73 C; 273/73 G

[58] Field of Search ..... 273/73 R, 73 C, 73 D, 273/73 G, 73 H, 73 L

[56] References Cited

U.S. PATENT DOCUMENTS

| | | | |
|---|---|---|---|
| 4,094,505 | 6/1978 | Beall, Jr. | 273/73 C |
| 4,139,194 | 2/1979 | Fischer | 273/73 C |
| 4,185,822 | 1/1980 | Li | 273/73 L X |
| 4,196,901 | 4/1980 | Durbin | 273/73 G |
| 4,274,634 | 6/1981 | Berlati | 273/73 L |
| 4,357,012 | 11/1982 | Maynard | 273/73 L |
| 4,390,182 | 6/1983 | You | 273/73 C |
| 4,655,455 | 4/1987 | Kurusu | 273/73 C |
| 4,798,382 | 1/1989 | Janes | 273/73 D X |

FOREIGN PATENT DOCUMENTS

| | | | |
|---|---|---|---|
| 208945 | 7/1957 | Australia | 273/73 C |
| 3204442 | 9/1983 | Fed. Rep. of Germany | 273/73 L |
| 2373302 | 8/1978 | France | 273/73 L |
| 2581317 | 11/1986 | France | 273/73 L |

*Primary Examiner*—Edward M. Coven
*Assistant Examiner*—William E. Stoll
*Attorney, Agent, or Firm*—Andsel Group, Inc.

[57] ABSTRACT

A racket for striking a ball that has an outer frame and a inner frame attached to the outer frame between at about a 10 o'clock position and a two o'clock position. The outer and inner frames are ovoid shaped with the small end of the ovoid shape toward the crown of the outer frame. There are a plurality of first and second port means and a plurality of chamber means to facilitate stringing of a ball engaging webbing. The racket has a bifurcated extension attached to a shaft which is attached to a handle. The flexing leverage is introduced at the crown instead of at the handle allowing the ball to remain on the strings longer to yield greater accuracy and power. The inner frame tends to align in parallel with the longitudinal axis of the handle at the approximate moment of the impact of the ball when the lower part of the inner frame flexes past the outer frame.

1 Claim, 2 Drawing Sheets

RACKET

BACKGROUND OF THE INVENTION

1. Field of the invention

This invention relates to a racket for striking a ball. The construction of this racket with its flexing inner frame causes a directed redistribution of energy. This increases the player's control over the placement of the ball.

2. Description of the Related Art

In the past, many configurations of rackets have been offered to enhance a user's control over the ball U.S. Pat. No. 2,109,525, to F.W. Donisthorpe on Mar. 1, 1938 describes a racket with a grip portion spaced away from the head approximately a distance equal to the length of the grip and having the forked portion and the head portion one continuous laminate. There is a slot in side member to allow an awl to be inserted at the junction of the head and the side member.

U.S. Pat. No. 4,094,505 to Thomas E. Beall on June 13, 1978 for a tennis racket with a head that is cantilevered from the grip that supports the head and has two unconnected shafts. The head is separable from the side portions so that the heat may be strung separately.

U.S. Pat. No. 4,139,194 to Josef Fisher on Feb. 13, 1979 for a racket shows a bifurcated handle with a head attached to the forks by a plurality of vibration-absorbing elastic elements to cushion the blow to the user.

U.S. Pat. No. 4,185,822 to Yao T. Li on Jan. 29, 1980 describes a racket with a inner head resiliently attached by means of an elastic insert to an outer head and with the stringing done from the top of the inner head U.S. Pat. No. 4,655,455 to Shozo Kurusu on Apr. 7, 1987 shows a racket with one stringed head spot welded to a forked frame to provide increased control of the ball.

SUMMARY OF THE INVENTION

The purpose of this invention is to redistribute the energy encountered during the moment when the racket impacts the ball. The racket redistributes the energy by a controlled flexing of the head that allows the player to more accurately direct the flight of the ball. The racket is directed toward tennis rackets. But the racket could be used for other balls or birdies.

The present invention is a racket for striking a ball. The racket has an outer frame, an inner frame attached to the outer frame at a crown of the outer frame, a shaft, a bifurcated extension attached to a first end of the shaft and attached to the outer frame and a handle attached to a second end of the shaft.

A preferred embodiment of the racket for striking a ball has an outer frame with the outer frame being ovoid shaped and has an inner frame attached to the outer frame at a crown of the outer frame from between approximately a ten o'clock position on the outer frame to approximately a two o'clock position on the outer frame. The inner frame is ovoid shaped with the smaller end of the ovoid shape of the inner frame being toward the crown of the outer frame. The smaller end of the ovoid shape of the outer frame is the crown of the outer frame. There is a shaft, a bifurcated extension attached to a first end of the shaft and attached to the outer frame. There is an interconnecting bridge on the bifurcated extension that attaches to a first side and to a second side of the bifurcated extension. A handle is attached to a second end of the shaft. There is a plurality of first port means on the outer frame to facilitate stringing a ball engaging webbing onto the inner frame and a plurality of second port means in the inner frame to facilitate stringing a ball engaging webbing onto the inner frame. There is a chamber means in the inner frame to facilitate stringing a ball engaging webbing onto the inner frame.

The inner frame may be attached at approximately a twelve o'clock position of a crown of the outer frame.

An embodiment of a racket for striking a ball has a handle, a shaft with a first end attached to the handle, an outer frame attached to a second end of the shaft, an inner frame attached to the outer frame at a crown of the outer frame, the inner frame being ovoid shapes and a smaller end of the ovoid shape of the inner frame being toward the crown of the outer frame.

Another embodiment of a racket for striking a ball has a handle, a shaft with a first end attached to the handle, a support member with a second end and a third end attached to the shaft and the support member forming an outer frame and an inner frame that are one piece and that are connected at a crown of the outer frame The inner frame and the outer frame are ovoid shaped. The smaller end of the ovoid shape of the inner frame being toward the crown of the outer frame and the smaller end of the ovoid shape of the outer frame being the crown of the outer frame.

It is an object of the present invention to provide a racket that has an inner frame that is connected at the crown or apex of the outer frame in contrast from the conventional racket which is connected at the handle and at a throat bridge.

It is a further object of this invention to provide a racket where the flexing leverage is introduced at the crown instead of at the shoulders and the handle.

It is anchor object to provide a racket that when pressure is applied, by the racket striking the ball, the pressure is applied from the point of contact to the crown first thus so the stringe surface and the axis of the handle remain more parallel yielding greater control, accuracy and power.

It is a further object of the invention to provide a racket that allows the lower part of the inner frame to flex independently of the outer frame and to address the ball at an angle more in line with the desired line of flight chosen by the user.

It is an object to provide a racket where the face of the inner frame tends to align in parallel with the longitudinal axis of the handle at the approximate moment of impact of the ball to enhance the users control of the departing flight of the ball.

DESCRIPTION OF THE PREFERRED EMBODIMENTS

Figure 1:
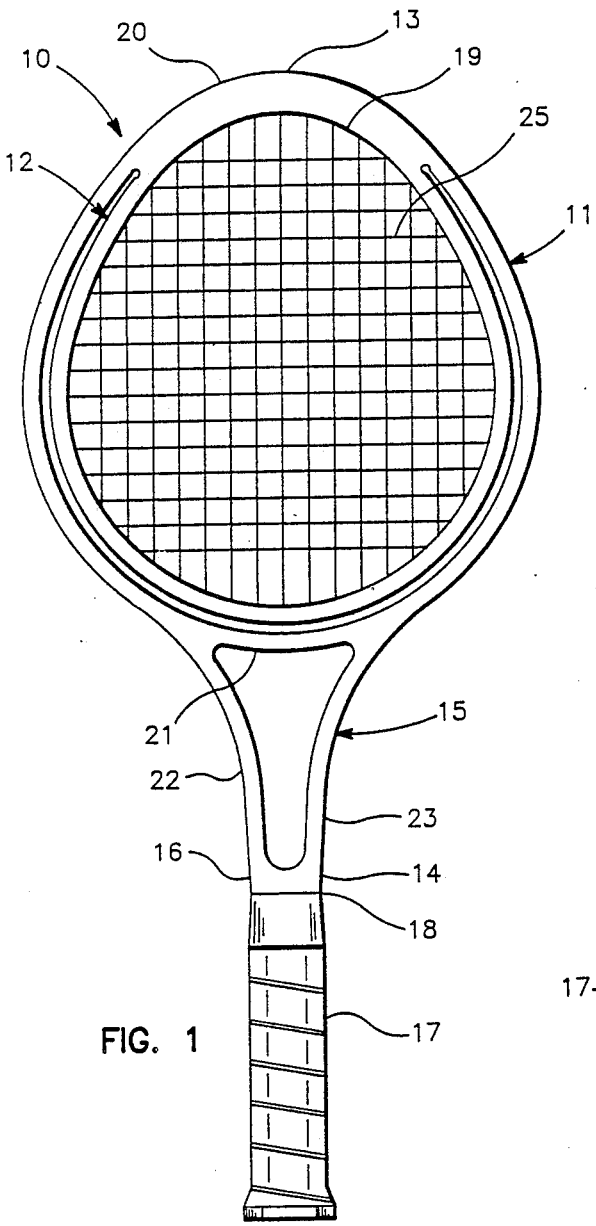
FIG. 1 is a longitudinal front view of the preferred embodiment.
Figure 2:
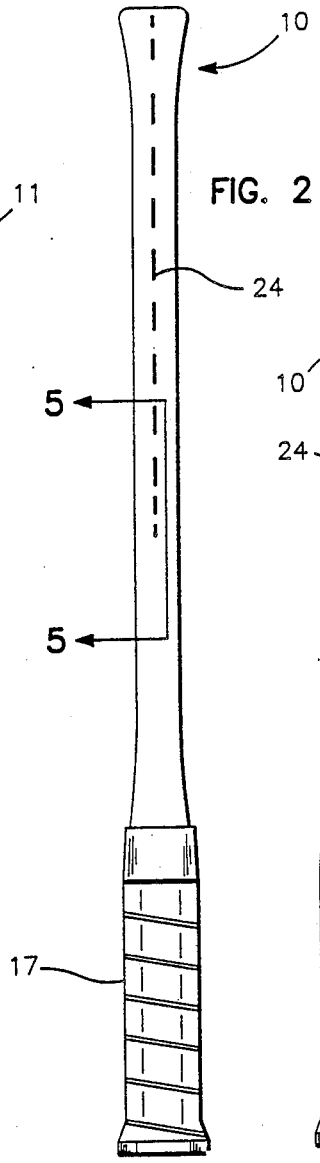
FIG. 2 is a side view of FIG. 1 with the inner frame at a state of rest.
Figure 3:
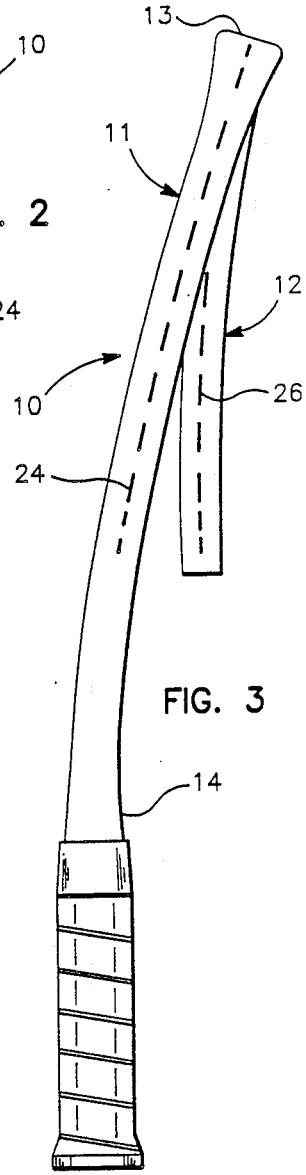
FIG. 3 is a side view of FIG. 1 with the inner frame in a position as it would be at the point of impact with a ball. The view shows the flexing of the inner frame in relation to the flexing of the outer frame.
Figure 4:
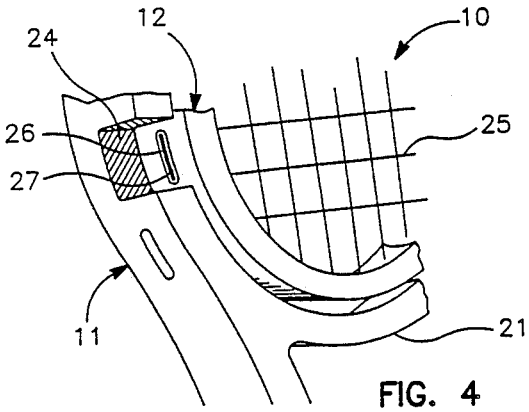
FIG. 4 is an expanded fragmented view of a section of the racket in FIG. 1.
Figure 5:
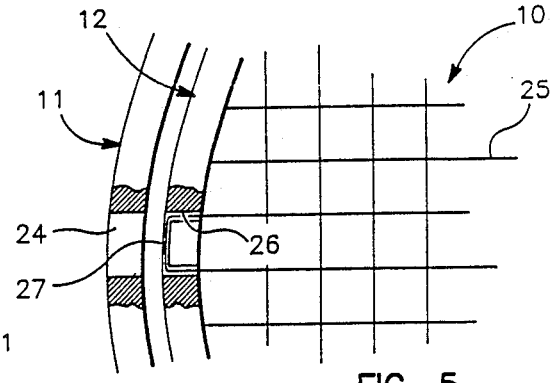
FIG. 5 is an expanded fragmented view of a section of the racket shown in FIG. 1 showing a partial cross sectional view of the inner and outer frames.

A racket 10 is shown in FIGS. 1, 2 and 3. The racket has an ovoid shaped outer frame 11 An inner frame 12 is attached to the outer frame 11 from between approximately a ten o'clock position on the outer frame 11 to approximately a two o'clock position on the outer frame 11. This is in the area of the crown 13 of the racket 10. A crown is the top section of a racket frame. The inner frame 12 is also ovoid shaped. A smaller end 19 of the ovoid shape of the inner frame 12 is toward the crown 13 of the outer frame 11 The smaller end 20 of the ovoid shape of the outer frame 11 is the crown of the outer frame 11. There is a shaft 14. A bifurcated extension 15 is attached to a first end 16 of the shaft 14 and the extension 15 is also attached to the outer frame 11. There is an interconnecting bridge 21 on the bifurcated extension 15 that is attached to a first side 22 and a second side 23 of the bifurcated extension 15. There is a handle 17 attached to a second end 18 of the shaft 14. There are a plurality of first port means 24 on the outer frame 11 to facilitate stringing a ball engaging webbing 25 onto the inner frame 12. There are also a plurality of second port means 26 in the inner frame to facilitate string a ball engaging webbing 25 onto the inner frame 12. There is a chamber means 27 to facilitate stringing a ball engaging webbing 25 onto the inner frame 12. The chamber means 27 leads into second port means 26 and reduces abrasion of the webbing.

Figure 6:
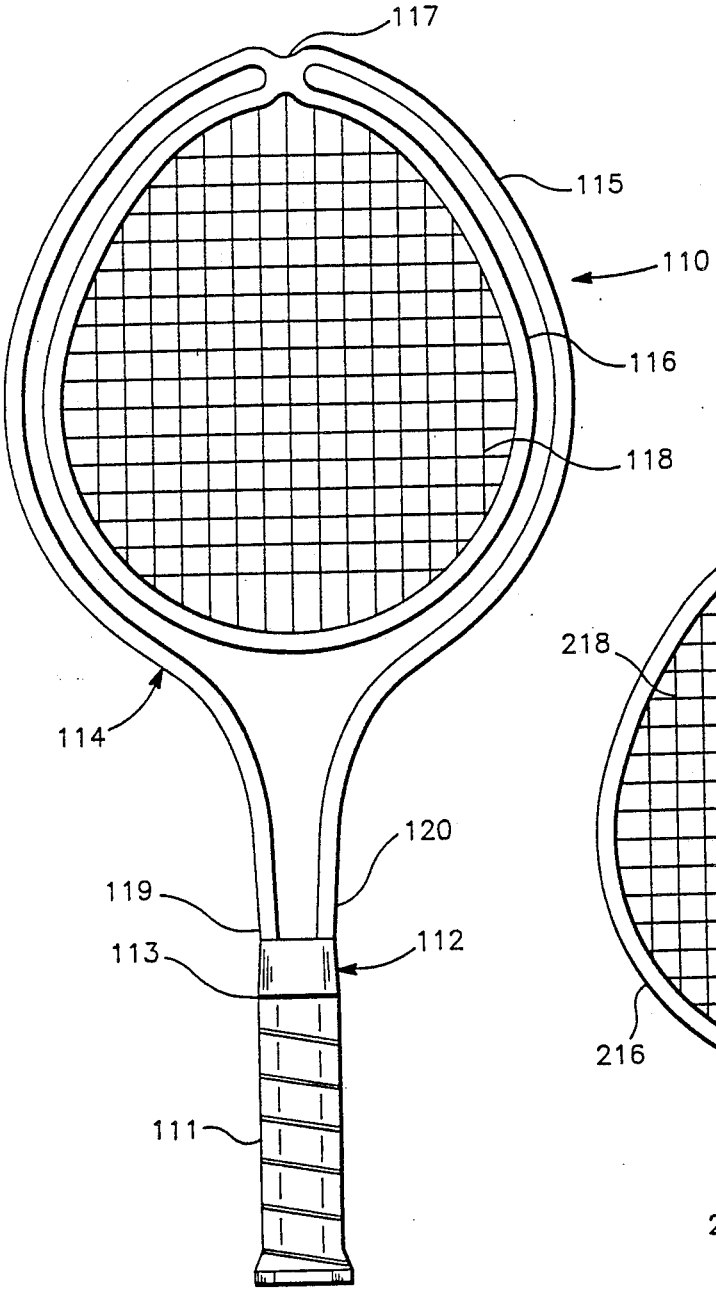
FIG. 6 is a longitudinal front view of an alternative embodiment of the racket.

An alternative embodiment of the invention is shown in FIG. 6 as racket 110 This embodiment shows a different manner of constructing the inner and outer frames There is a handle 111 and a shaft 112 with a first end 113 attached to the handle 111. There is a support member 114 with a second end 119 and a third end 120 attached to the shaft 112. The support member 114 forms an outer frame 115 and an inner frame 116 that are one piece and that are connected at the crown 117 of the outer frame 115. The inner frame 116 and the outer frame 115 are ovoid shaped. The smaller end of the ovoid shape of the inner frame 116 is toward the crown 117 of the outer frame 115. The smaller end of the ovoid shape of the outer frame 115 is the crown 117 of the outer frame 115. This embodiment has similar webbing 118, first and second port means and chamber means (not shown) as does the preferred embodiment. It functions the same way when striking the ball.

Figure 7:
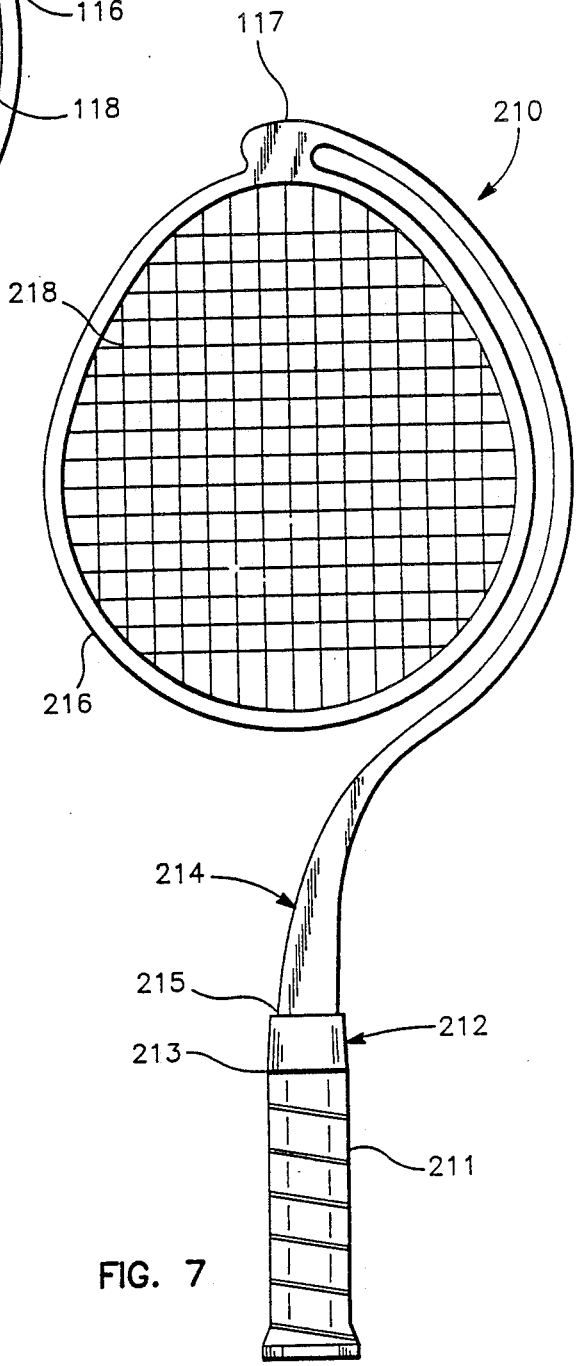
FIG. 7 is a longitudinal front view of another alternative embodiment of the racket.

FIG. 7 shows another alternative embodiment 21Q of the preferred embodiment 10 of the invention. This embodiment shows yet another manner of constructing the inner and outer frames. There is shown a handle 211 with a shaft 212 that has a first end 213 attached to the handle 211 There is an outer frame 214 attached to a second end 215 of the shaft 212. There is an inner frame 216 attached to the outer frame 214 at a crown 217 of the outer frame 214. The inner frame 216 is ovoid shaped and the smaller end of the ovoid shape of the inner frame 216 is toward the crown 217 of the outer frame 214. This embodiment has similar webbing 218, first and second port means and chamber means (not shown) as does the preferred embodiment. It functions the same way when striking the ball.

The foregoing descriptions and drawings of the invention are explanatory and illustrative only, and various changes in shapes, sizes and arrangement of parts as well as certain details of the illustrated construction may be made within the scope of the appended claims without departing from the true spirit of the invention.

I claim:

1. A racket for striking a ball comprising:

a. an outer frame;

b. the outer frame being ovoid shaped;

c. an inner frame attached to the outer frame at a crown of the outer frame from between approximately a ten o'clock position on the outer frame to approximately a two o'clock position on the outer frame;

d. the inner frame being ovoid shaped;

e. a smaller end of the ovoid shape of the inner frame being toward the crown of the outer frame;

f. a smaller end of the ovoid shape of the outer frame being the crown of the outer frame;

a shaft;

h. a bifurcated extension attached to a first end of the shaft and attached to the outer frame;

i. an interconnecting bridge on the bifurcated extension that attaches to a first side and to a second side of the bifurcated extension;

j. a handle attached to a second end of the shaft;

k. a plurality of first port means on the outer frame to facilitate stringing a ball engaging webbing onto the inner frame;

l. a plurality of second port means in the inner frame to facilitate stringing a ball engaging webbing onto the inner frame; and m. a chamber means in the inner frame to facilitate stringing a ball engaging webbing onto the inner frame.

* * * * *